United States Patent [19]

Murakami et al.

[11] 4,429,558

[45] Feb. 7, 1984

[54] METHOD OF AND APPARATUS FOR FABRICATION OF SPIRAL FIN

[75] Inventors: Hiroya Murakami; Mitsuhiro Takasaki; Osamu Yamada, all of Yokohama; Atsuya Kamada, Kamakura; Katsuyoshi Hori, Kure, all of Japan

[73] Assignee: Hitachi, Ltd., Tokyo, Japan

[21] Appl. No.: 254,285

[22] Filed: Apr. 15, 1981

[30] Foreign Application Priority Data

Apr. 15, 1980 [JP] Japan ..... 55-48720

[51] Int. Cl.[3] ..... B21D 11/08; B21D 43/00; B21C 37/22; B23P 15/26

[52] U.S. Cl. ..... 72/17; 72/136; 72/142; 72/205; 29/157.3 AH

[58] Field of Search ..... 29/157.3 AH; 72/135, 72/136, 140, 142, 144, 145, 17, 18, 205; 226/195; 242/156.2

[56] References Cited

U.S. PATENT DOCUMENTS

| | | | |
|---|---|---|---|
| 1,850,886 | 3/1932 | Lane et al. | 72/136 X |
| 2,262,227 | 11/1941 | Fulson | 72/136 |
| 3,160,195 | 12/1964 | Dobell | 72/136 X |
| 3,177,937 | 4/1965 | Slough | 29/157.3 AH |
| 3,216,232 | 11/1965 | Stikeleather | 29/157.3 AH |
| 3,247,696 | 4/1966 | Stikeleather | 72/136 |
| 3,926,353 | 12/1975 | Gay | 226/195 X |
| 4,033,492 | 7/1977 | Imai | 72/17 X |
| 4,079,611 | 3/1978 | Osterkorn et al. | 29/157.3 AH |
| 4,199,117 | 4/1980 | Muller et al. | 226/195 X |

*Primary Examiner*—E. Michael Combs

*Attorney, Agent, or Firm*—Antonelli, Terry & Wands

[57] ABSTRACT

A method of and an apparatus for fabricating a spiral fin in which a strip of material is bent with rolling by a pair of rolls while being imparted with a tension to reduce the speed at which the strip is drawn between the pair of rolls to reduce a compressive force applied to a portion of the strip corresponding to an outer edge portion of the spiral fin, thereby improving the forming limit of the spiral fin.

7 Claims, 7 Drawing Figures

METHOD OF AND APPARATUS FOR FABRICATION OF SPIRAL FIN

BACKGROUND OF THE INVENTION

This invention relates to a method of and an apparatus for the fabrication of a spiral fin wherein a strip of material of rectangular cross section is formed into a spiral shape and wound on the outer periphery of a tube in one operation.

One constituent element of a heat exchanger is a finned tube having a spiral fin wound on the outer periphery of the tube. The finned tube is produced by what is generally referred to as a rolling and bending operation whereby a strip of metal of rectangular cross section payed out of a supply reel is rolled by a roll of a larger diameter, referred to as a rolling pan (or a pan roll), and a roll of a smaller diameter, referred to as a spindle roll, arranged in predetermined spacing relation with respect to the former roll with the rolling reduction being increased linearly in going from the inner edge of the spiral fin in contact with a tube toward the outer edge thereof, so that the strip is bent spirally and at the same time wound on the tube.

It is known that the inner diameter of a spiral fin is determined by the difference in rolling reduction between the inner edge portion and the outer edge portion of the fin when the width of the strip is constant. Thus, to fabricate a spiral fin of a small inner diameter by using a strip of a constant width, it is necessary that the difference in rolling reduction between the inner edge portion and the outer edge portion of the strip be increased. That is, the outer edge portion should have a larger rolling reduction.

Generally, in a rolling operation, the strip can be bitten well by the rolls and drawn quickly between the rolls when a rolling reduction is small. However, as a rolling reduction increases, slip would occur between the strip and the rolls, so that the strip would not be bitten well by the rolls and would be drawn with difficulty between the rolls.

In rolling and bending a strip to fabricate a spiral fin, the strip is drawn between the rolls at a speed close to the drawing speed at which the widthwise central portion of the strip, having a substantially mean rolling reduction, is drawn and rolled by the rolls, because the inner edge portion and the outer edge portion of the spiral fin have different rolling reductions. Because of this, slip has tended to occur between the rolls and the strip in a portion thereof corresponding to the inner edge portion of the spiral fin. Meanwhile, the strip has a tendency to be subjected, in a portion thereof corresponding to the outer edge portion of the spiral fin, to a compressive force which forces the strip between the rolls, due to the fact that the strip is fed between the rolls in this portion at a speed higher than the rolling speed of the strip as a whole.

When the spiral fin to be fabricated has a small inner diameter as compared with the width of the strip used, the compressive force applied to a portion of the strip corresponding to the outer edge portion of the spiral fin, as described hereinabove, would increase in intensity, so that partial buckling would occur in the strip immediately before being drawn between the rolls. Thus, the fabricated spiral fin would have riffles in its outer edge portion which would render the spiral fin unacceptable for specifications. When such riffles occur in the outer edge portions, processing of the spiral fin in the following steps would be interferred with, thereby reducing the operation efficiency in the fabrication of the spiral fin.

When the difference in rolling reduction between the inner edge portion and the outer edge portion of the spiral fin is increased to obtain a small inner diameter in the spiral fin, the compressive force applied to the outer edge portion of the spiral fin is increased in intensity as aforesaid, and this would increase the thickness of the strip before it is drawn between the rolls. Combined with deformation of the rolls due to an increase in rolling load, this would result in the strip being bitten intermittently by the rolls or the strip not being bitten at all. When the strip is intermittently bitten by the rolls, rupture would occur in the outer edge portion of the fabricated spiral fin. When the strip is bitten by the rolls, it would be impossible to continue the rolling and bending operation.

Under these circumstances, it has not been the performance which a finned tube of a heat exchanger is required to show but the limitations placed by the operation to be performed on a strip for fabricating a spiral fin that have been a predominant factor in deciding the dimensions of the spiral fins and tubes. Thus, the present tendency is to use tubes and spiral fins of larger dimensions than are necessary, raising the serious problem of wasting material from the point of view of conserving natural resources and reducing production cost.

SUMMARY OF THE INVENTION

This invention has as its object the provision of an apparatus for the fabrication of a spiral fin enabling a smaller inner diameter to be obtained in a spiral fin from a strip of the same diameter than in the prior art and permitting the thickness of the spiral fin to be reduced.

The outstanding characteristic of the invention enabling the aforesaid object to be accomplished is that a tension is imparted to the strip being drawn between the rolls by the rotation of the latter to make the speed at which the strip is drawn between the rolls as close as possible to the speed at which the outer edge portion of the spiral fin is rolled, so as to reduce the compressive force applied to a portion of the strip corresponding to the outer edge portion of the spiral fin, thereby improving the forming limit of the fin.

DESCRIPTION OF THE PREFERRED EMBODIMENT

Figure 1:
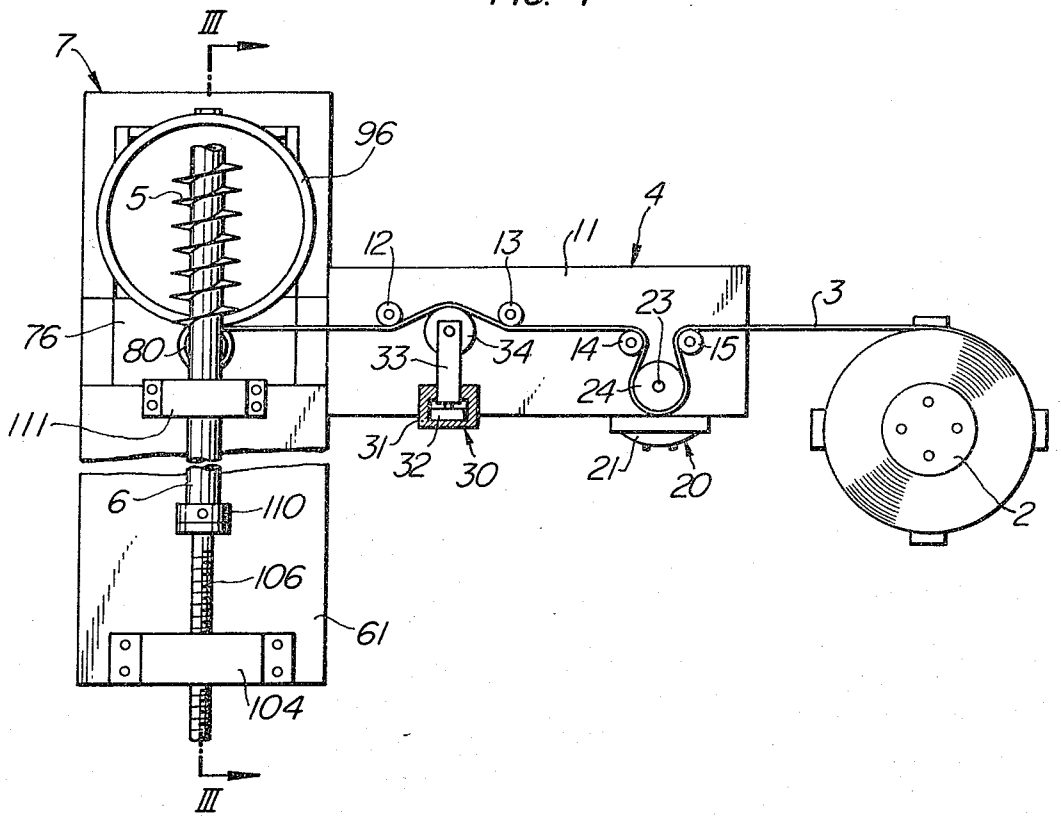
FIG. 1 is a plan view of the apparatus for the fabrication of a spiral fin comprising one embodiment of the invention.

As shown in FIGS. 1–6, the apparatus for the fabrication of a spiral fin according to the invention comprises tensioning means generally designated by the reference numeral 4 for imparting a tension to a strip of material 3 of a rectangular cross section payed out of a supply reel 2 rotatably supported on a stand 1, and shaping means generally designated by the reference numeral 7 spirally bending the strip 3 in convolutions into a spiral fin 5 and winding the spiral fin 5 on a tube 6.

The tensioning means 4 comprises a tension imparting mechanism generally designated by the reference numeral 20 for imparting a tension to the strip 3, a sensing mechanism generally designated by the reference numeral 30 for sensing the tension imparted to the strip 3, and a control mechanism 40 (FIG. 6) connected to the sensing mechanism 30 for controlling the tension imparting mechanism 20 based on the output of the sensing mechanism 30 so as to thereby control the tension imparted to the strip 3.

The tensioning means 4 comprises four rollers 12, 13, 14 and 15 mounted for rotation on a table 11 for leading the strip 3 from the supply reel 2 to the shaping means 7 as the strip 3 is moved past the rollers 12, 13, 14 and 15.

The tension imparting mechanism 20 comprises an electromagnetic brake 21, hereinafter referred simply as a brake, supported on the underside of the table 11, and a brake drum 24 secured to a rotary shaft 23 of the brake 21 journaled by a bearing 22 and rotatably extending through the table 11. The strip 3 is trained over the brake drum 24 and a tension is imparted to the strip 3 by the force of friction produced between the brake drum 24 and strip 3 and the brake force produced by the brake 21.

The sensing mechanism 30 comprises a main body 31 secured on the table 11, a piezoelectric transducer element 32 mounted in the main body 31, a rod 33 slidably extending through the main body 31 and in contact with the piezoelectric transducer element 32 at one end, and a roller 34 rotatably supported on the other end of the rod 33. The roller 34 is located midway between the rollers 12 and 13 to press against a portion of the strip 3 moving between the rollers 12 and 13 and to transmit the reaction of the strip 3 through the rod 23 to the piezoelectric transducer element 32 which produces an electric signal of a value commensurate with the reaction of the strip 3.

Figure 6:
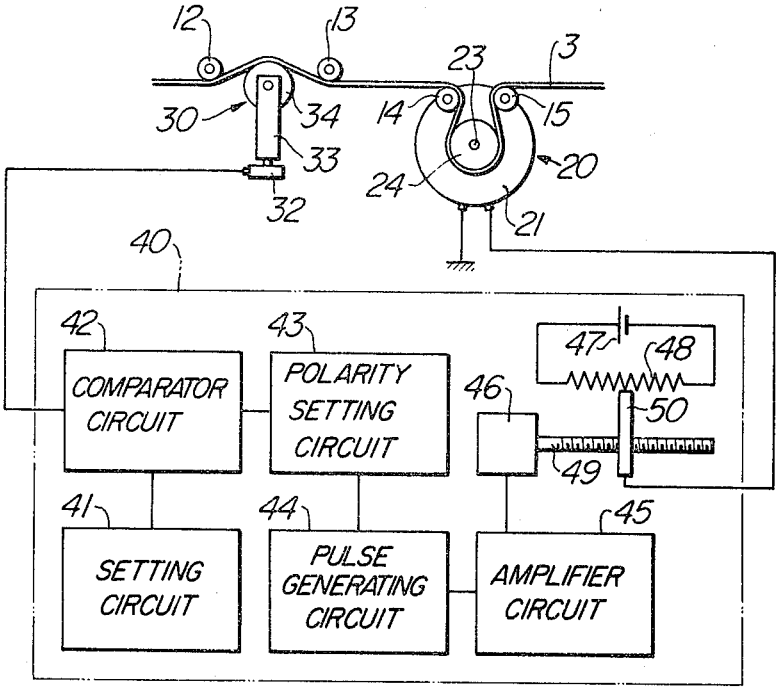
FIG. 6 is a block diagram of the control means.

As shown most clearly in FIG. 6, the control mechanism 40 comprises a setting circuit 41 for setting a voltage corresponding to a tension serving as a reference, a comparator circuit 42 connected to the piezoelectric transducer element 32 and the setting circuit 41 for comparing the output of the piezoelectric transducer element 32 with the voltage set by the setting circuit 41, a polarity setting circuit 43 connected to the comparator circuit 42 for determining the polarity based on the result of comparison transmitted from the comparator circuit 42, a pulse generating circuit 44 connected to the polarity setting circuit 43 for generating pulses of a polarity as required based on the instructions received from the polarity setting circuit 43, an amplifier circuit 45 connected to the pulse generating circuit 44 amplifying the pulses generated by the pulse generating circuit 44 and applying the amplified pulses to a pulse motor 46, a feed screw 49 located parallel to a resistor 48 connected to a power source 47 for the brake 21 and connected to a rotary shaft of the pulse motor 46, and a contact member 40 threadably coupled to the feed screw 49 and slidably in contact with the resistor 48, the contact member 50 drawing off a current which is impressed on the brake 21.

Figure 2:
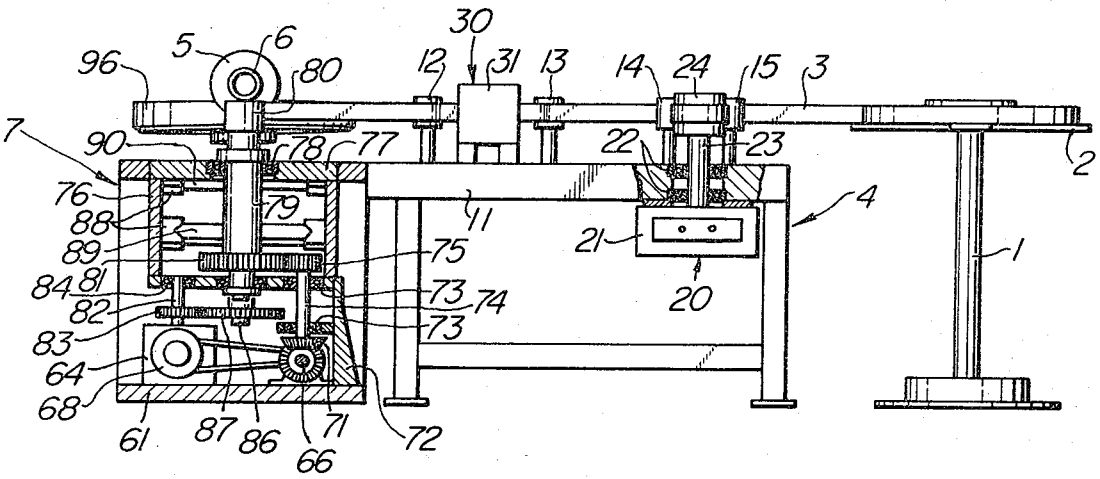
FIG. 2 is a front view, with certain parts being shown in section of the apparatus shown in FIG. 1.
Figure 3:
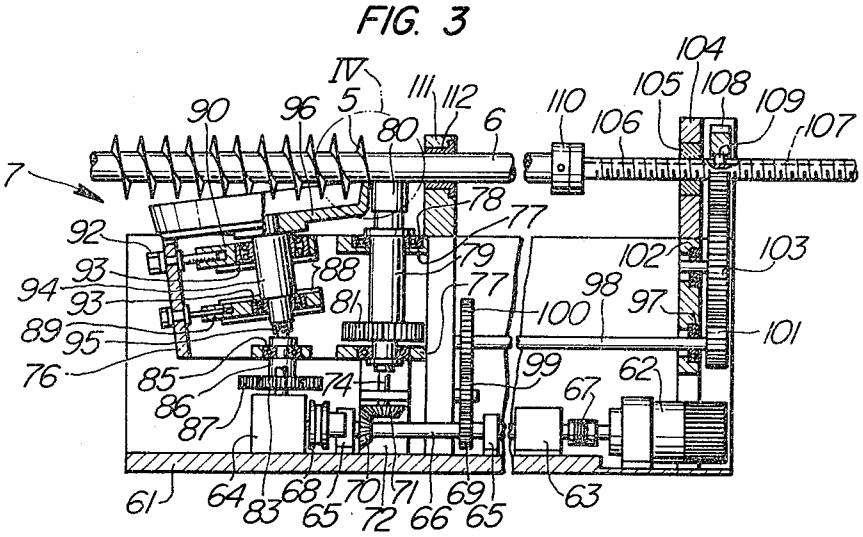
FIG. 3 is a view with certain parts being shown in section along the line III—III in FIG. 1.
Figure 4:
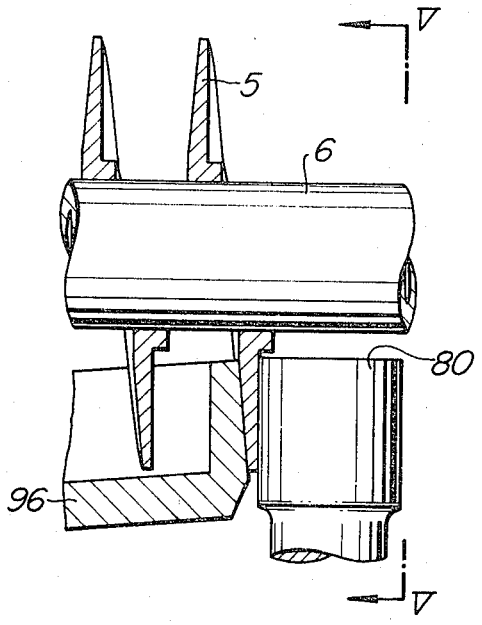
FIG. 4 is an enlarged sectional view of the part shown by IV in FIG. 3.
Figure 5:
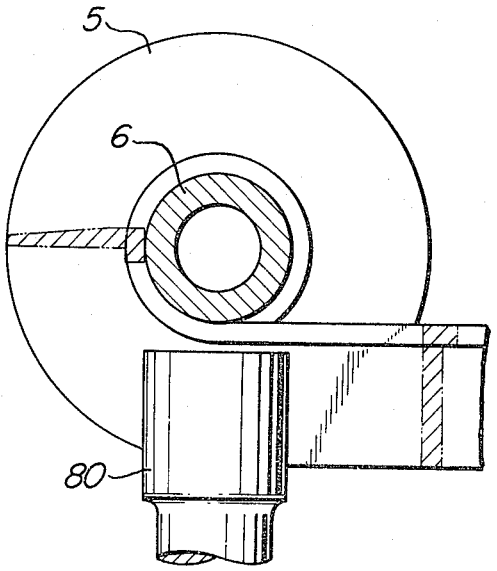
FIG. 5 is a sectional view along the line V—V in FIG. 4 with two cross sections of the strip being shown for reference.

As shown most clearly in FIGS. 2 and 3, the shaping means 7 comprises a motor 62, an electromagnetic clutch brake 63 and a speed change gearing 64, all mounted at the bottom of a table 61 disposed adjacent the table 11. A main spindle 66, journaled by a pair of bearings 65, is supported on the bottom surface of the table 61 and connected at one end to the electromagnetic clutch brake 63. The motor 62 is connected to the electromagnetic clutch brake 63 through a coupling 67 to rotate the main spindle 66. The speed change gearing 64 is connected through an infinitely variable speed change gearing 68 to the other end of the main spindle 66 having attached thereto a spur gear 69 and a bevel gear 70. The bevel gear 70 meshes with another bevel gear 71 supported at a lower end of an intermediate shaft 74 rotatably supported through a bearing 73 by a stand 72 on the table 61. A spur gear 75 is secured to an upper end of the intermediate shaft 74. A shaft 79 is rotatably supported through a bearing 78 by a frame 77 of a bearing box 76. The shaft 79 is formed at one end thereof with a roll 80 for rolling and bending the strip 3 and supports, at its lower end, a spur gear 51 meshing with the spur gear 75. Thus, rotation of the main spindle 66 causes the roll 80 to rotate. A spur gear 83 is secured to a follower shaft 82 of the speed reducing gearing 64 which is rotatably supported at one end thereof by the bearing box 76 through a bearing 84. A spur gear 87, meshing with the spur gear 83, is secured to a lower end of an intermediate shaft 86 rotatably supported by the bearing box 76 having two pairs of guide members 88, one pair above and the other pair below in the box 76. Slide plates 89 and 90 are slidably held between the pairs of guide members 89 and 90 and have connected thereto rolling reduction adjusting screws 91 and 92, respectively, which are rotatably supported by the bearing box 76. Thus, rotation of the screws 91 and 92 causes the slide plates 89 and 90 to move in sliding movement along the guide members 88. A shaft 94 is rotatably supported by the slide plates 89 and 90 through a self-aligning bearing 93, with the shaft 94 being connected at its lower end through a universal joint 95 to the intermediate shaft 86 and secured to its upper end a roll 96 for rolling and bending the strip 3 positioned against the roll 80. Thus, rotation of the main spindle 66 causes the two rolls 80 and 96 to rotate. The infinitely variable speed change gearing 68 effects adjustments of synchronization of the two rolls 80 and 96. The rolling reduction to be obtained in the strip 3 can be adjusted by regulating the gap between the rolls 80 and 96 by rotating the screws 91 and 92.

A shaft 98, rotatably supported by the table 51 through a bearing 97, has secured to one end thereof a spur gear 100 meshing with the spur gear 69 through an intermediate gear 99 rotatably supported by the table 61 and has secured to the other end thereof a spur gear 101 in meshing engagement with an intermediate gear 103 rotatably supported by the table 61 through a bearing 102. Secured on the table 61 is a support member 104 having secured thereto a nut 105 threadably engaging a feed screw 106. A keyway 107, parallel to the axis of the feed screw 106, is formed on its outer periphery. The feed screw 106 has fitted thereon a gear 108, meshing with the intermediate gear 103, capable of axial sliding movement. A key slidably fitted in the keyway 107 is inserted between the gear 108 and feed screw 106. Thus, rotation of the gear 108 is transmitted to the feed screw 106 through the key 109, causing the feed screw 106 to move axially thereof. At this time, the feed screw 106 and gear 108 start sliding in the axial direction, and the gear 108 starts rotating while meshing with the intermediate gear 103. The feed screw 106 has secured to one end thereof a chuck 110 for gripping the tube 6. Thus, rotation of the rolls 80 and 96 caused by actuation of the motor 62 causes the feed screw 106 to rotate in synchronism therewith, to thereby feed the tube 6 while rotating same. As a result, the spiral fin 5 is wound on the tube 6 at a lead angle equal to the lead angle of the feed screw 106. The tube 6 is supported for both sliding movement and rotary movement by a sleeve 112 supported by a support member 111 secured to the table 61.

In the apparatus of the aforesaid construction, the chuck 110 is returned to its original position on the side of the nut 105 to grip the tube 6. Meanwhile the strip 3 payed out of the supply reel 2 is trained over the brake drum 24 and guided by the rollers 13 and 12 to contact the roller 34, to be led to the path of its travel between the rolls 80 and 96. The setting circuit 41 sets a voltage corresponding to the tension serving as a reference, and a current is passed to the brake 21 to cause a brake force to be produced.

Then the motor 62 is actuated to initiate a spiral fin fabricating operation. The strip 3 successively fed from the supply reel 2 to the rolls 80 and 96 is rolled and bent by the rolls 80 and 96 into the spiral fin 5 which is wound in convolutions on the tube 6. At this time, the feed screw 106 rotates in synchronism with the rolls 80 and 96, to move the tube 6 axially while rotating it about its own axis. Thus, the spiral fin 5 is wound on the tube 6 at the same lead angle as the feed screw 106.

Meanwhile the strip 3 tends to be drawn between the rolls 80 and 96 at a speed close to the speed at which a portion of the strip 3 corresponding to the central portion of the spiral fin 5, having a mean rolling reduction, is drawn between the rolls 80 and 96. However, since the strip 3 is under the influence of the brake force produced by the brake 21, a tension is applied to a portion of the strip 3 between the rolls 80 and 96 and the brake drum 24. Owing to this tension, the strip 3 presses against the roller 34 which presses the piezoelectric transducer element 32 through the rod 33. This causes the piezoelectric transducer element 32 to produce a voltage output commensurate with the force with which the rod 33 presses against the piezoelectric transducer element 32 and apply same to the comparator circuit 42, where the voltage output supplied thereto from the piezoelectric transducer element 32 is compared with the voltage set by the setting circuit 41. As a result, an output of the comparator circuit 41, indicating which voltage has a higher value, is applied to the polarity setting circuit 43. The polarity setting circuit 43 sets the polarity of pulses to be impressed on the pulse motor 46 in accordance with the output of the comparator circuit 42, and gives instructions to the pulse generating circuit 44, which produces pulses of the predetermined polarity based on the instructions from the polarity setting circuit 43 and impresses same on the pulse motor 46 through the amplifier circuit 45, to thereby increase or decrease the value of the current passed to the brake 21. When the voltage output of the piezoelectric transducer element 32 is higher in value than the voltage set by the setting circuit 41, for example, the value of the current passed to the brake 21 is decreased to lower the brake force to facilitate the paying out of the strip 3 from the supply reel 2, to thereby reduce the tension of the strip 3. Conversely, when the output voltage of the piezoelectric transducer element 32 is lower in value than the voltage set by the setting circuit 41, the value of the current passed to the brake 21 is increased, to thereby increase the brake force and the tension of the strip 3.

By shaping the strip 3 into the spiral fin 5 by applying a tension to the strip 3 as aforesaid, it is possible to reduce the speed at which the strip 3 is drawn between the rolls 80 and 96 as compared with the speed at which the strip 3 is drawn between the rolls 80 and 96 without being tensioned. More specifically, when the spiral fin 5 is shaped without tensioning the strip 3, the strip 3 is drawn between the rolls 80 and 96 at a rolling speed at which a portion of the strip 3 corresponding to the central portion of the spiral fin 5 having a mean rolling reduction is drawn, so that an unnecessary compressive force is applied to the outer edge portion and acts forcibly thereon. However, when the spiral fin 5 is shaped while the strip 3 is being tensioned, the tension acts on the strip 3 in such a manner that the strip 3 is drawn between the rolls 80 and 96 at a rolling speed equal to the speed at which a portion of the strip 3 corresponding to the outer edge portion of the spiral fin 5 having a relatively high rolling reduction is drawn between the rolls 80 and 96, thereby minimizing the forcing action applied to the outer edge of the spiral fin 5. Thus, it is possible to improve the forming limit of a spiral fin.

Figure 7:
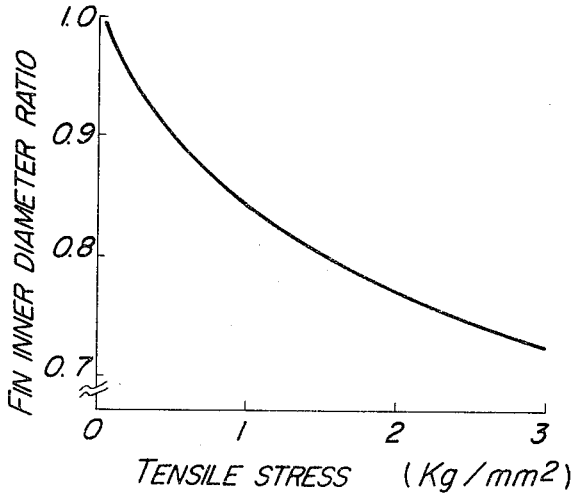
FIG. 7 is a diagram showing the relation between the tension of the strip and the forming limit of the spiral fin.

FIG. 7 is a diagram showing the inner diameter of the spiral fin in relation to the tension imparted to a strip of aluminum of the ratio of width of the thickness of $\approx 35$, wherein such strip can be worked to produce a spiral fin without riffles or other defects (forming limit). In the diagram, the abscissa represents the tensile stress produced in the strip due to the tension imparted thereto, and the ordinate indicates the ratio of the inner diameter at the forming limit with tensioning to the inner diameter at the forming limit without tensioning as expressed in terms of the inner diameter ratio. It will be seen in the diagram that the smaller the inner diameter of the spiral fin, the easier it becomes to bend the fin with a smaller diameter.

FIG. 7 shows that rolling and bending of a strip with a smaller diameter is made possible by tensioning the strip.

The table shown below indicates the relation between the thickness of the strip and the tension imparted thereto which is established when spiral fins of the same shape having the inner diameter of 25 mm and the width of 16 mm are fabricated. The table indicates that, when a tension of 3 kg/mm$^2$ is imparted, the fin can be finished in good condition up to a thickness of 0.2 mm.

TABLE

| | Thickness | | | |
|---|---|---|---|---|
| Tension | 0.35 (mm) | 0.3 (mm) | 0.25 (mm) | 0.2 (mm) |
| None | Good | Riffles on Outer Edge | Riffles on Inner and Outer Edges | Riffles All Over, Rupture at Outer Edge |
| 2.0 kg/cm$^2$ | Good | Good | Good | Riffles on Outer Edge |
| 3.0 kg/cm$^2$ | Good | Good | Good | Good |

This does not mean that the larger the tension imparted to a strip, the better results can be achieved. That is, an increase in tension increases the slip between the rolls and the strip until the strip is not bitten by the rolls. Stated differently, the slip between the strip and the rolls prevents the strip being drawn between the rolls, making it impossible to operate on the strip. Thus, the tension to be imparted to the strip is set at a range of values which does not interfere with the biting of the strip by the rolls. The maximum value of the tension is preferably decided by experiments each time spiral fin fabrication is carried out because it may vary depending on the type of the lubricant used, the speed of operation and other conditions of operation.

What is claimed is:

1. A method of fabricating a spiral fin in which a strip of material having a rectangular cross section is rolled and bent by a pair of rolls while being wound on a tube to form a spiral fin, wherein the method comprises imparting a tension to the strip being drawn between the pair of rolls, and controling the amount of tension imparted to the strip so that a speed at which the strip is drawn between the rolls is substantially equal to a speed at which an outer edge portion of the spiral fin is rolled so as to reduce a compressive force applied to a portion of the strip corresponding to the outer edge of the spiral fin.

2. A method as claimed in claim 1, wherein said strip is made of aluminum.

3. A method as claimed in claim 1 or 2, wherein the amount of tension imparted to the strip being drawn between the pair of rolls is at least 2.0 kg/cm$^2$ when the strip is of the thickness of at least 0.25 mm.

4. A method as claimed in claim 1 or 2, wherein the amount of tension imparted to the strip being drawn between the pair of rolls is at least 3.0 kg/cm$^2$ when the strip is of the thickness of at least 0.2 mm.

5. An apparatus for fabricating a spiral fin including a supply reel rotatably mounted for supporting a strip of material having a rectangular cross section, and rolling and bending means having a pair of rolls for bending with rolling therebetween the strip delivered from said supply reel and adapted to wind the strip on a tube fed in synchronism with the rotation of the rolls to form a spiral fin, wherein the apparatus comprises tension imparting means interposed between said supply reel and said pair of rolls for imparting a tension to the strip being drawn between the pair of rolls, and means for controlling the amount of tension imparted to the rolls so that a speed at which the strip is drawn between the rolls is substantially equal to a speed at which an outer edge of the spiral fin is rolled so as to reduce a compressive force applied to a portion of the strip corresponding to the outer edge of the spiral fin.

6. An apparatus as claimed in claim 5, wherein said tension imparting means comprises a brake drum over which said strip is trained, and an electromagnetic brake for applying the brake to said brake drum.

7. An apparatus as claimed in claim 5, wherein said tension imparting means comprises a brake drum over which said strip is trained, an electromagnetic brake for applying the brake to said brake drum, said means for controlling includes a sensing mechanism interposed between said brake and said brake drum in a manner to contact the strip, to sense the tension imparted to the strip, and a control mechanism regulating a voltage impressed on the electromagnetic brake based on the result achieved by said sensing mechanism, to thereby control the brake force produced by the electromagnetic brake and amount of tension imparted to the strip.

* * * * *